US010218099B2

(12) United States Patent
Kang et al.

(10) Patent No.: US 10,218,099 B2
(45) Date of Patent: Feb. 26, 2019

(54) BOARD CONNECTOR

(71) Applicant: Sumitomo Wiring Systems, Ltd., Yokkaichi, Mie (JP)

(72) Inventors: Liping Kang, Mie (JP); Kenji Okamura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/471,559

(22) Filed: Mar. 28, 2017

(65) Prior Publication Data

US 2017/0294725 A1 Oct. 12, 2017

(30) Foreign Application Priority Data

Apr. 12, 2016 (JP) ..... 2016-079561

(51) Int. Cl.
*H01R 12/71* (2011.01)

(52) U.S. Cl.
CPC ..... *H01R 12/716* (2013.01)

(58) Field of Classification Search
CPC ..... H01R 12/7029; H01R 12/7064; H01R 12/716; H01R 12/57; H01R 13/73; H01R 12/7052; H01R 12/707; H01R 12/71; H01R 12/7082
See application file for complete search history.

(56) References Cited

U.S. PATENT DOCUMENTS 5,257,948 A * 11/1993 Peterson ..... H01R 12/7029 439/571
5,827,089 A * 10/1998 Beck, Jr. ..... H01R 12/7029 439/567
6,024,602 A * 2/2000 Mchugh ..... H01R 12/7029 439/567
6,053,767 A * 4/2000 Copper ..... H01R 12/7029 439/567
6,280,247 B1 * 8/2001 Wu ..... H01R 12/7052 439/570
6,461,177 B1 * 10/2002 Saka ..... H01R 13/4362 439/157
6,475,031 B1 * 11/2002 Wu ..... H01R 12/707 439/570
6,540,553 B1 * 4/2003 Wu ..... H01R 12/7029 439/567
6,663,406 B1 * 12/2003 Wu ..... H01R 12/7029 439/326

(Continued)

FOREIGN PATENT DOCUMENTS

JP 2000-294325 10/2000

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A board connector (10) includes a receptacle (20) fittable to a mating connector and fixing members (60) for fixing the receptacle (20) to a circuit board (90). The receptacle (20) is in the form of a rectangular tube and has a pair of side walls (21) facing each other in a width direction and a bottom wall (22) and a ceiling wall (23) facing each other in a height direction. At least either the side walls (21) or the bottom wall (22) include(s) mounting recesses (31) for mounting the fixing members (60) within a wall thickness between an inner side surface and an outer side surface of the receptacle (20).

6 Claims, 15 Drawing Sheets

(56) References Cited

U.S. PATENT DOCUMENTS

| | | | | |
|---|---|---|---|---|
| 6,918,792 | B2 * | 7/2005 | Hu | H01R 13/2442 439/630 |
| 7,077,694 | B2 * | 7/2006 | Nakano | H01R 12/707 439/533 |
| 7,837,492 | B2 * | 11/2010 | Zhu | H01R 12/57 439/329 |
| 7,963,803 | B1 * | 6/2011 | Yang | H01R 12/7052 439/627 |
| 9,325,115 | B2 * | 4/2016 | Zhang | H01R 13/64 |
| 2002/0115332 | A1 * | 8/2002 | Myer | H01R 13/641 439/352 |
| 2006/0019511 | A1 * | 1/2006 | Tanaka | H01R 12/707 439/74 |
| 2007/0015415 | A1 * | 1/2007 | Yang | H01R 13/508 439/676 |
| 2009/0305556 | A1 * | 12/2009 | Kawahara | H01R 12/7029 439/544 |
| 2009/0311887 | A1 * | 12/2009 | Zhu | H01R 12/707 439/67 |
| 2010/0112836 | A1 * | 5/2010 | Aihara | H01R 13/639 439/79 |
| 2010/0288547 | A1 * | 11/2010 | Hayashi | H01R 12/7029 174/260 |
| 2014/0227895 | A1 * | 8/2014 | Takamoto | A63F 13/02 439/133 |
| 2016/0093977 | A1 * | 3/2016 | Chen | H01R 12/7029 439/345 |
| 2016/0276761 | A1 * | 9/2016 | Endo | H01R 12/716 |

* cited by examiner

BOARD CONNECTOR

BACKGROUND

1. Field of the Invention

The invention relates to a board connector.

2. Description of the Related Art

Japanese Unexamined Patent Publication No. 2000-294325 discloses a connector with a connector body made of synthetic resin, and thick wing-like parts project out from both widthwise sides of the connector body. Metal locking members are mounted respectively in thick wing-like parts at the widthwise sides of the connector body. Each locking member includes a part to be press-fit and fixed to the wing-like parts at the widthwise sides of the connector body and a part to be inserted and locked to a through hole of a circuit board. Thus, the connector body is fixed to the circuit board via the locking members. However, there is a concern that the thick wing-like parts projecting out from the widthwise end parts of the connector body enlarge the entire connector.

The present invention was completed based on the above situation and aims to provide a board connector capable of avoiding enlargement.

SUMMARY

The invention is directed to a board connector with a receptacle that can fit to a mating connector. The receptacle is a rectangular tube with two side walls that face each other in a width direction and a bottom wall and a ceiling wall that face each other in a height direction. A fixing member fixes the receptacle to a circuit board. At least one of the side wall or the bottom wall has a mounting recess for mounting the fixing member within a wall thickness between an inner side surface and an outer side surface of the receptacle. The mounting recess does not enlarge the receptacle and, thus the entire board connector is not enlarged.

The mounting recesses may be arranged within wall thicknesses of both side walls. Thus, the fixing members are mounted in a well-balanced manner.

The receptacle may have a back wall and the mounting recess may be open toward a side from which a terminal fitting to be mounted through the back wall is to be inserted. Thus, an inserting direction of the fixing member into the mounting recess and an inserting direction of the terminal fitting through the back wall can be the same so that assembling operability is excellent.

The side wall may include an erroneous connection prevention receiving portion for receiving an erroneous connection preventing portion of the mating connector. The erroneous connection prevention receiving portion may be a recess open on an inner side surface of the side wall. A part on the side of the bottom wall may have a larger height than a part on the side of the ceiling wall in the height direction of the side wall across the erroneous connection prevention receiving portion. The mounting recess may be arranged within a wall thickness of the part on the side of the bottom wall. According to this configuration, the side wall is thick, and the part on the side of the bottom wall has a larger height than the part on the side of the ceiling wall. Thus, a formation area of the mounting recess can be ensured within the wall thickness of the part on the side of the bottom wall. Further, a strength reduction of the side wall due to the presence of the mounting recess can be suppressed.

The fixing member may be a metal plate with an inserting piece extending in an inserting direction into the mounting recess and a fixing piece extending from the inserting piece toward the circuit board. Thus, the structure of the fixing member can be simplified and, consequently, the structure of the mounting recess for receiving the fixing member can be simplified.

DETAILED DESCRIPTION

A first embodiment is described with reference to FIGS. 1 to 6. A board connector 10 of the first embodiment is to be mounted on a printed circuit board 90 and includes a receptacle 20 made of synthetic resin and fixing members 60 made of metal. The fixing members 60 are mounted into the receptacle 20 and soldered and fixed to the circuit board 90.

Figure 1:
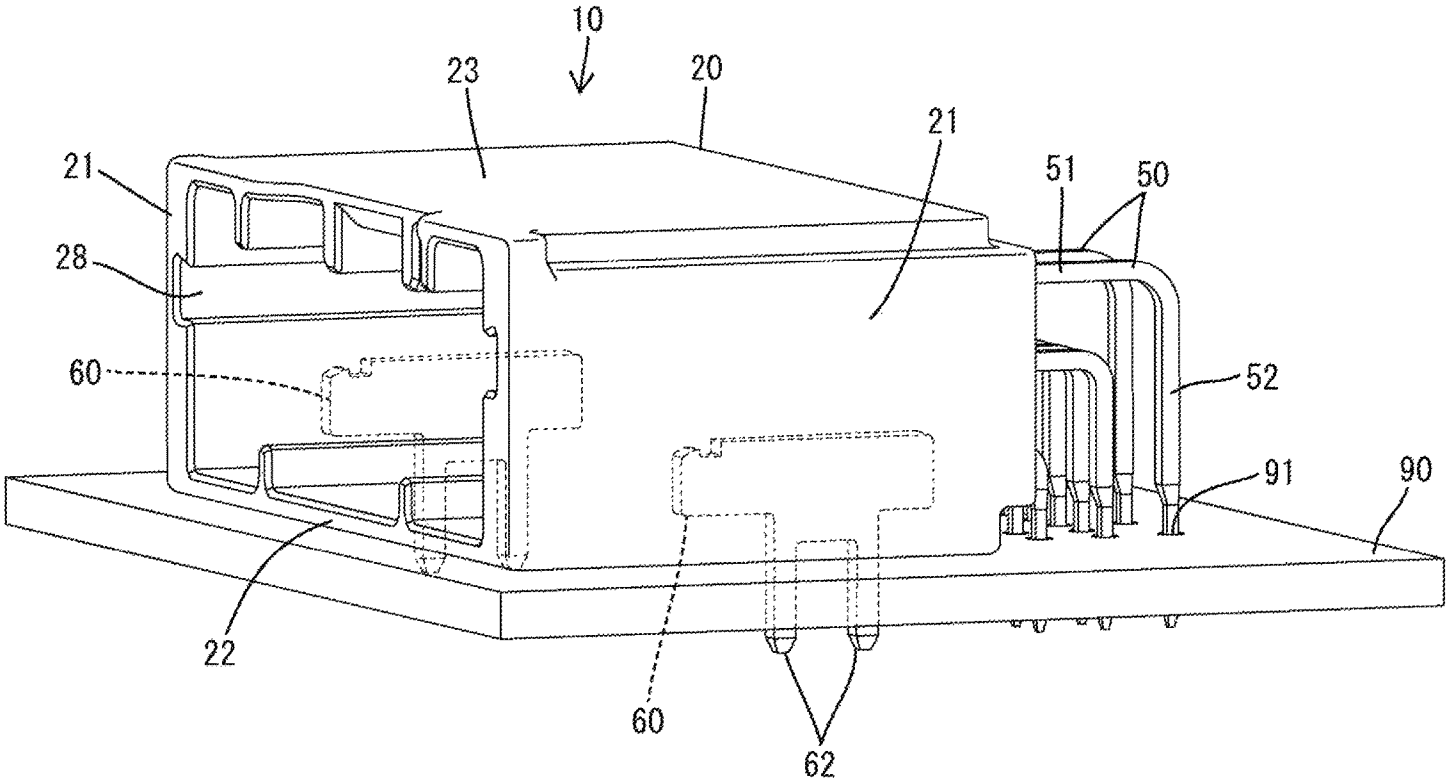
FIG. 1 is a perspective view of a board connector mounted on a circuit board in a first embodiment of the present invention.
Figure 2:
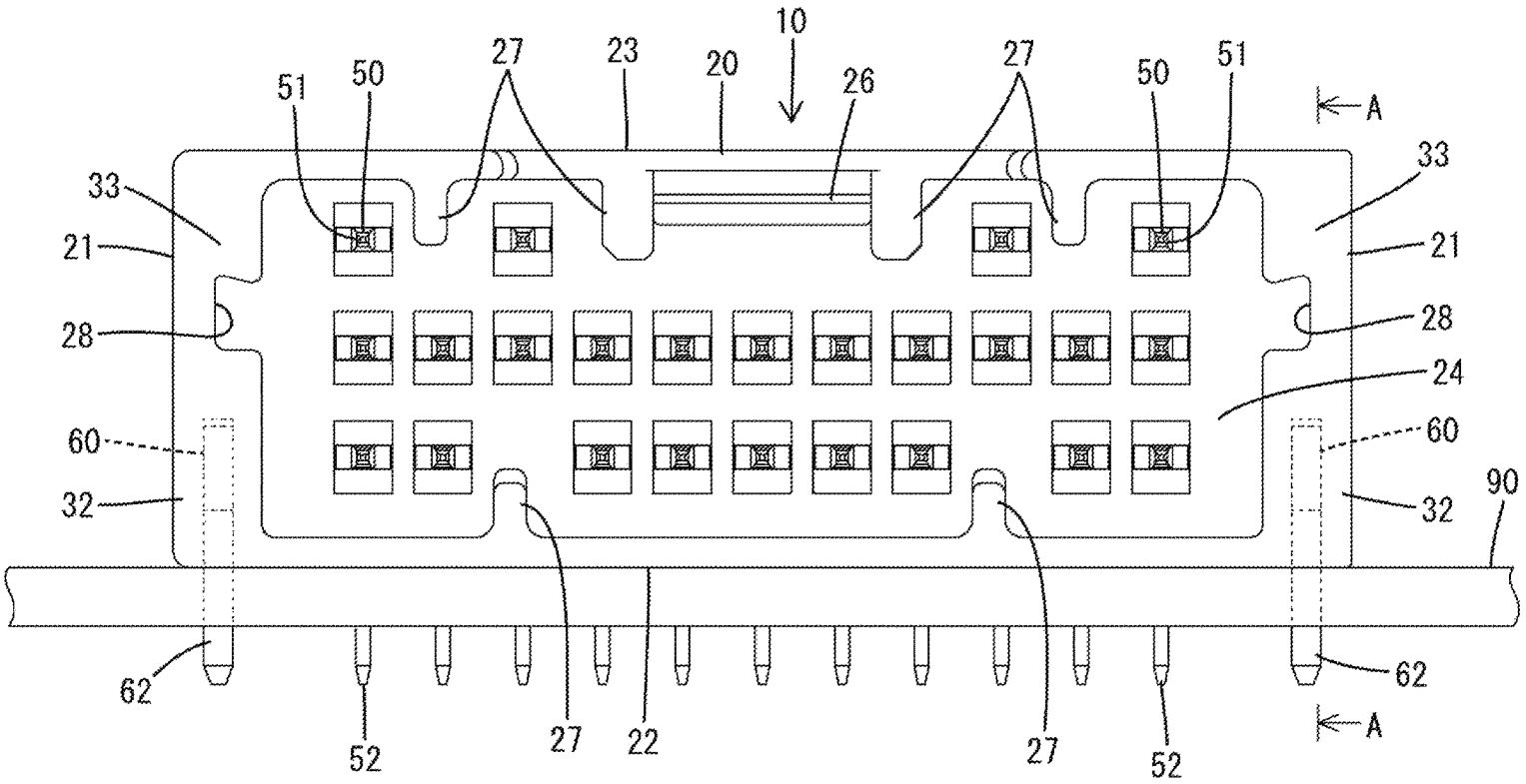
FIG. 2 is a front view of the board connector mounted on the circuit board.

As shown in FIGS. 1 and 2, the receptacle 20 is a forwardly open rectangular tube with two side walls 21, a bottom wall 22, a ceiling wall 23 and a back wall 24. A mating connector (not shown) can fit into the receptacle 20 from the front.

Figure 4:
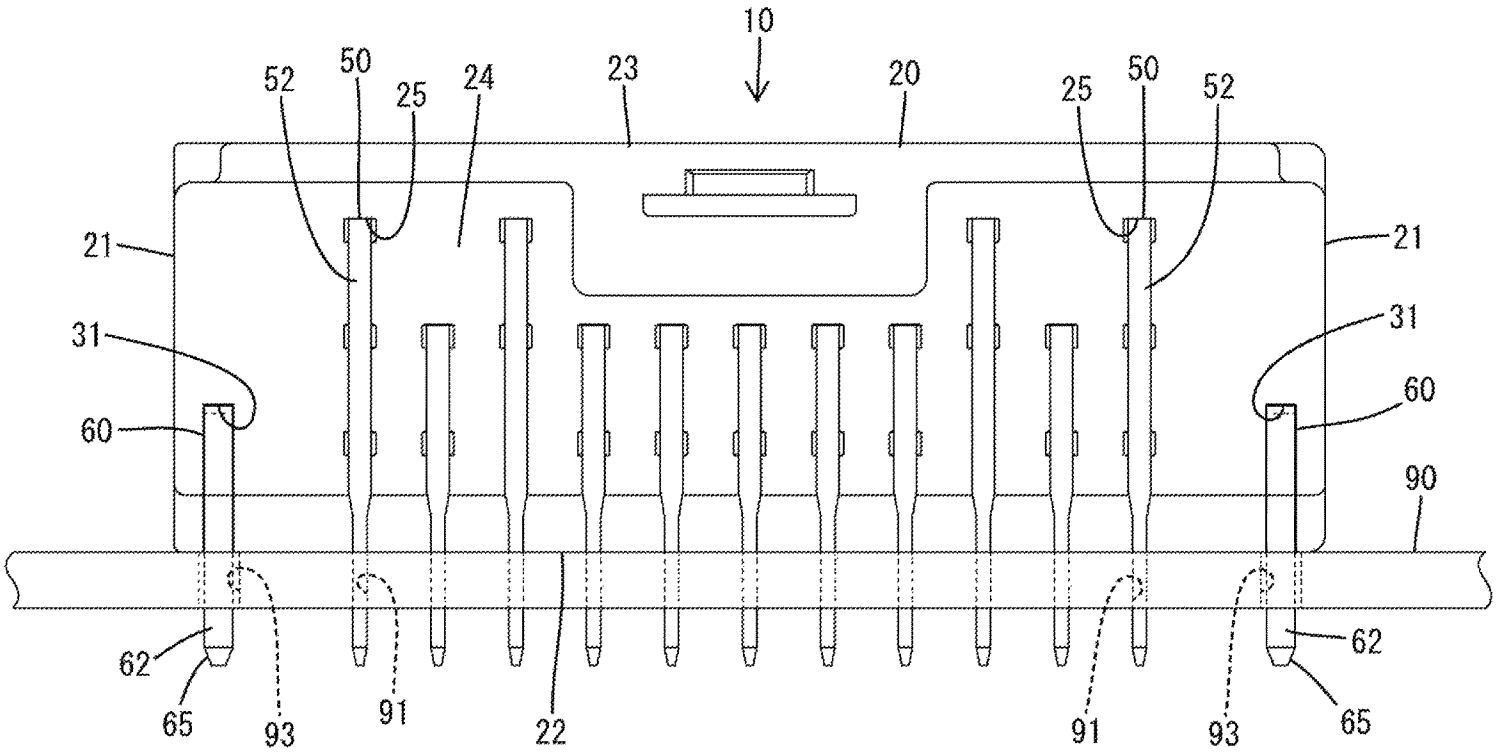
FIG. 4 is a back view of the board connector mounted on the circuit board.

The side walls 21 are arranged in a height direction (vertical direction as shown) and face each other in a width direction (lateral direction of FIGS. 2 and 4).

The bottom wall 22 and the ceiling wall 23 are connected between both ends of the side walls 21 in the height direction and are arranged along the width direction while facing each other in the height direction. The ceiling wall 23 is connected between the upper ends of the side walls 21, while the bottom wall 22 is connected between the lower ends of the side walls 21 to face a surface of the circuit board 90. The back wall 24 extends along the height direction between the respective rear ends of the side walls 21, the bottom wall 22 and the ceiling wall 23. Widths of the bottom wall 22 and the ceiling wall 23 are larger than those of the side walls 21. Thus, the receptacle 20 has a wide flat shape.

Figure 3:
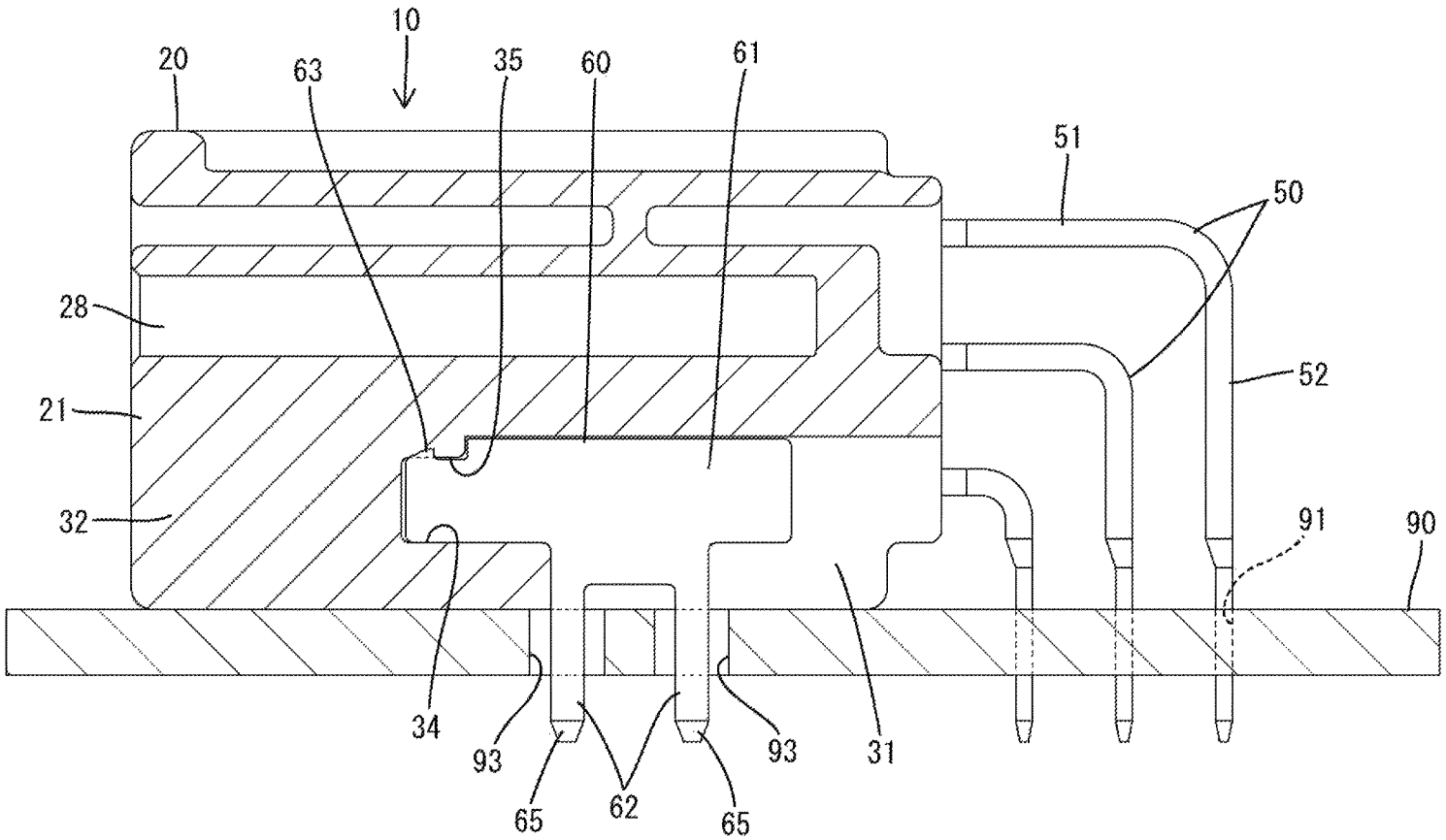
FIG. 3 is a section along A-A of FIG. 2.

Terminal fittings 50 project into the receptacle 20, as shown in FIG. 2. Each terminal fitting 50 is a square pin made of metal and has a horizontal portion 51 extending in a front-rear direction and a vertical portion 52 bent to extend down from the rear end of the horizontal portion 51, as shown in FIG. 3. The horizontal portion 51 is in the receptacle 20 and conductively connects a mating terminal fitting (not shown) mounted in the mating connector. The horizontal portion 51 is press-fit from behind into one of terminal mounting holes 25 (see FIG. 4) in upper, middle and lower stages on the back wall 24. A lower end part of the vertical portion 52 is inserted into a connection hole 91 on the circuit board 90 and soldered and conductively connected to a conductive path (not shown) of the circuit board 90.

A rib-like lock protrusion 26 is provided on an inner side surface of the ceiling wall 23 and is long and narrow in the width direction. The lock protrusion 26 is locked to a lock arm (not shown) of the mating connector to hold the two connectors in a connected state.

Inner side surfaces of the bottom wall 22 and the ceiling wall 23 are provided with long narrow erroneous connection preventing ribs 27 extending rearward from a front end. The erroneous connection preventing ribs 27 of the ceiling wall 23 project down and are at opposite sides of the lock protrusion 26 and at positions near both widthwise ends. The erroneous connection preventing ribs 27 of the bottom wall 22 project up and are on both widthwise sides between the erroneous connection preventing ribs 27 of the ceiling wall 23 in the width direction.

Two erroneous connection prevention receiving grooves 28 are provided at positions of inner side surfaces of both side walls 21 closer to the ceiling wall 23 than a center in the height direction (positions close to an upper end). Each erroneous connection prevention receiving groove 28 extends in the front-rear direction and has a cross-section open on the inner side surface and the front end of the side wall 21. Although not shown, the mating connector has erroneous connection preventing grooves at positions corresponding to the erroneous connection preventing ribs 27 and elongated erroneous connection projections at positions corresponding to the erroneous connection prevention receiving grooves 28.

If the mating connector is in a proper connecting posture, the erroneous connection preventing ribs 27 are fit into the erroneous connection preventing grooves and the erroneous connection preventing portions are fit into the erroneous connection prevention receiving grooves 28 and a connecting operation of the both connectors smoothly proceeds. On the other hand, if the mating connector is vertically inverted or in a posture oblique to the front-rear direction, the erroneous connection preventing ribs 27 contact an end surface of the mating connector and the erroneous connection preventing portions contact the front end of the receptacle 20 to prevent the connectors from being connected erroneously, such as by being forcibly connected.

As shown in FIG. 2, outer and inner side surfaces of both side walls 21 are substantially flat vertical surfaces that are continuous without any unevenness, except in parts corresponding to the erroneous connection prevention receiving portions 28. The side walls 21 have substantially equal wall thicknesses (dimension between the inner and outer side surfaces of the receptacle 20). Further, the bottom wall 22 and the ceiling wall 23 also have a substantially equal wall thickness. The wall thicknesses of the side walls 21 (except in parts corresponding to the erroneous connection prevention receiving portions 28) are larger than those of the bottom wall 22 and the ceiling wall 23 (except in parts corresponding to the erroneous connection preventing ribs 27 and the lock protrusion 26) because the inner side surfaces of the side walls 21 are recessed to form the erroneous connection prevention receiving portions 28.

Figure 5:
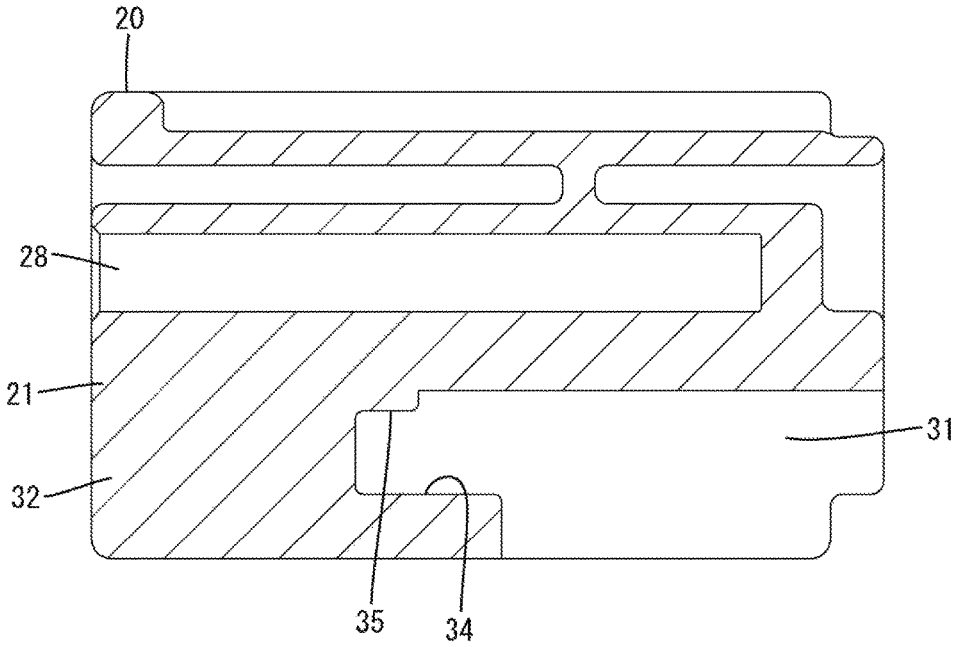
FIG. 5 is a side view in section of a side wall of a receptacle.

The side walls 21 include mounting recesses 31 for mounting the fixing members 60, as shown in FIG. 5. Each mounting recess 31 is arranged within the wall thickness of a lower part 32 on the side of the bottom wall 22 in the height direction of the side wall 21 across the erroneous connection prevention receiving portion 28. Specifically, the mounting recess 31 extends in the front-rear direction and the height direction and is open on the rear end and the lower end of the side wall 21. The front end of the mounting recess 31 is located before a center of the receptacle 20 in the front-rear direction and the upper end thereof is slightly below a center of the receptacle 20 in the height direction. Rear and lower openings of the mounting recess 31 in the side wall 21 are slits corresponding to a cross-sectional shape of the fixing member 60 when viewed from the front.

As shown in FIG. 3, a front lower part of the mounting recess 31 is located behind a front end upper part, and a step 34 extends along the front-rear direction between the front end lower part and the front end upper part of the mounting recess 31. Further, a slightly lowered step 35 is provided on an upper front part of the mounting recess 31.

Figure 6:
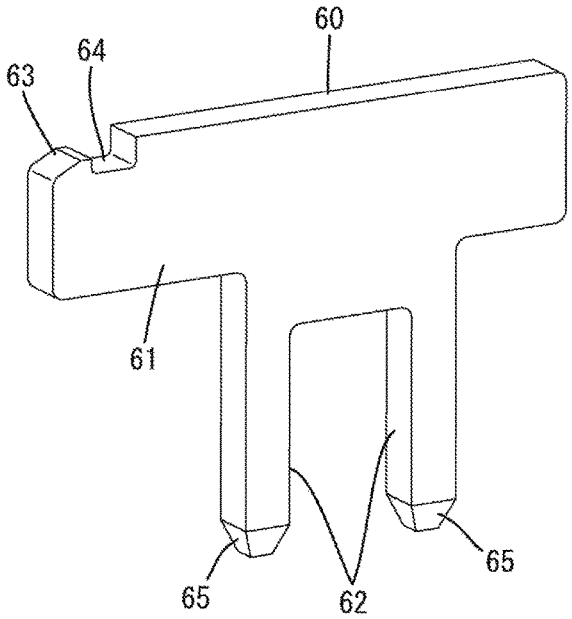
FIG. 6 is a perspective view of a fixing member.

The fixing member 60 is a flat plate made of metal and inserted into the mounting recess 31 from behind with plate surfaces oriented in the width direction as shown in FIGS. 3 and 4. Specifically, as shown in FIG. 6, the fixing member 60 is composed of an inserting piece 61 extending in the front-rear direction and two fixing pieces 62 extending down from front and rear parts of the inserting piece 61. The inserting piece 61 is a strip plate and includes a claw-like projection 63 on an upper end front edge. The projection 63 projects into a recess 64 slightly lowered on an upper end front part of the inserting piece 61. The fixing piece 62 is a square pin whose width in the front-rear direction is slightly larger than that of the terminal fitting 50 and includes a guiding portion 65 tapered toward a lower end.

Next, the procedure of mounting the board connector 10 on the circuit board 90 is described.

In assembling the fixing member 60, the inserting piece 61 is inserted along the step portion 34 from behind and is mounted into a front side of the mounting recess 31 (see FIG. 3). The projection 63 is press-fit to the step 35 at a final stage of a mounting process and bites into the step 35 to be locked when the mounting is completed. Further, when the mounting is completed, the front fixing piece 62 contacts the front end lower part of the mounting recess 31 to be stopped and the lower part of the fixing piece 62 projects downward of the side wall 21. The fixing members 60 are mounted into the mounting recess 31 of each of the side walls 21.

Subsequently, the receptacle 20 is placed on the surface of the circuit board 90 from above. When the bottom wall 22 comes into contact with the surface of the circuit board 90, the vertical portions 52 of the terminal fittings 50 are inserted into the connection holes 91 of the circuit board 90 from above and the front and rear fixing pieces 62 of the fixing members 60 are inserted into fixing holes 93 of the circuit board 90 from above. At this time, the fixing pieces 62 are inserted individually into the fixing holes 93. Thereafter, the vertical portions 52 of the terminal fittings 50 and the fixing pieces 62 of the fixing members 60 are soldered and fixed to the circuit board 90 by flow soldering or reflow soldering. The fixing pieces 62 are arranged at positions near centers of the side walls 21 in the front-rear direction in both widthwise end parts of the receptacle 20. Thus, the receptacle 20 is fixed stably to the circuit board 90.

According to the first embodiment, the receptacle 20 is a rectangular tube formed by the two side walls 21, the bottom wall 22 and the ceiling wall 23. The mounting recesses 31 are formed within the wall thickness between the inner and outer side surfaces of the side walls 21 of the receptacle 20. Thus, the mounting recesses 31 do not project from the outer side surfaces of the side walls 21 and do not require the receptacle 20 to be enlarged.

Further, the disposition of the mounting recesses 31 within the wall thicknesses of the side walls 21 ensures that the fixing members 60 are mounted in a well-balanced manner.

The mounting recesses 31 are open toward the rear ends of the side walls 21, and hence at the end of the receptacle 20 from which the terminal fittings 50 are inserted. Thus, the fixing members 60 and the terminal fittings 50 are inserted in the same direction so that assembling operability is excellent.

The side wall 21 includes the erroneous connection prevention receiving portion 28 for receiving the erroneous connection preventing portion of the mating connector. The erroneous connection prevention receiving portion 28 is a recess that opens on the inner side surface of the side wall 21. Thus, the lower part 32 on the side of the bottom wall 22 has a larger height than an upper part 33 on the side of the ceiling wall 23 in the height direction of the side wall 21 across the erroneous connection prevention receiving portion 28, and the mounting recess 31 is arranged within the wall thickness of the lower part 32 (see FIG. 2). Thus, the lower part 32 of the side wall 21 is thick and has a large height, a formation area of the mounting recess 31 can be sufficiently ensured within the wall thickness of the lower part 32 of the side wall 21, and a strength reduction of the side wall 21 due to the presence of the mounting recess 31 can be suppressed.

The fixing member 60 includes the metal inserting piece 61 extending in the front-rear direction and the two fixing pieces 62 extending down from both front and rear ends of the inserting piece 61. Thus, the fixing member 60 has a relatively simple structure, and the structure of the mounting recess 31 for receiving the fixing member 60 also can be simplified.

Figure 7:
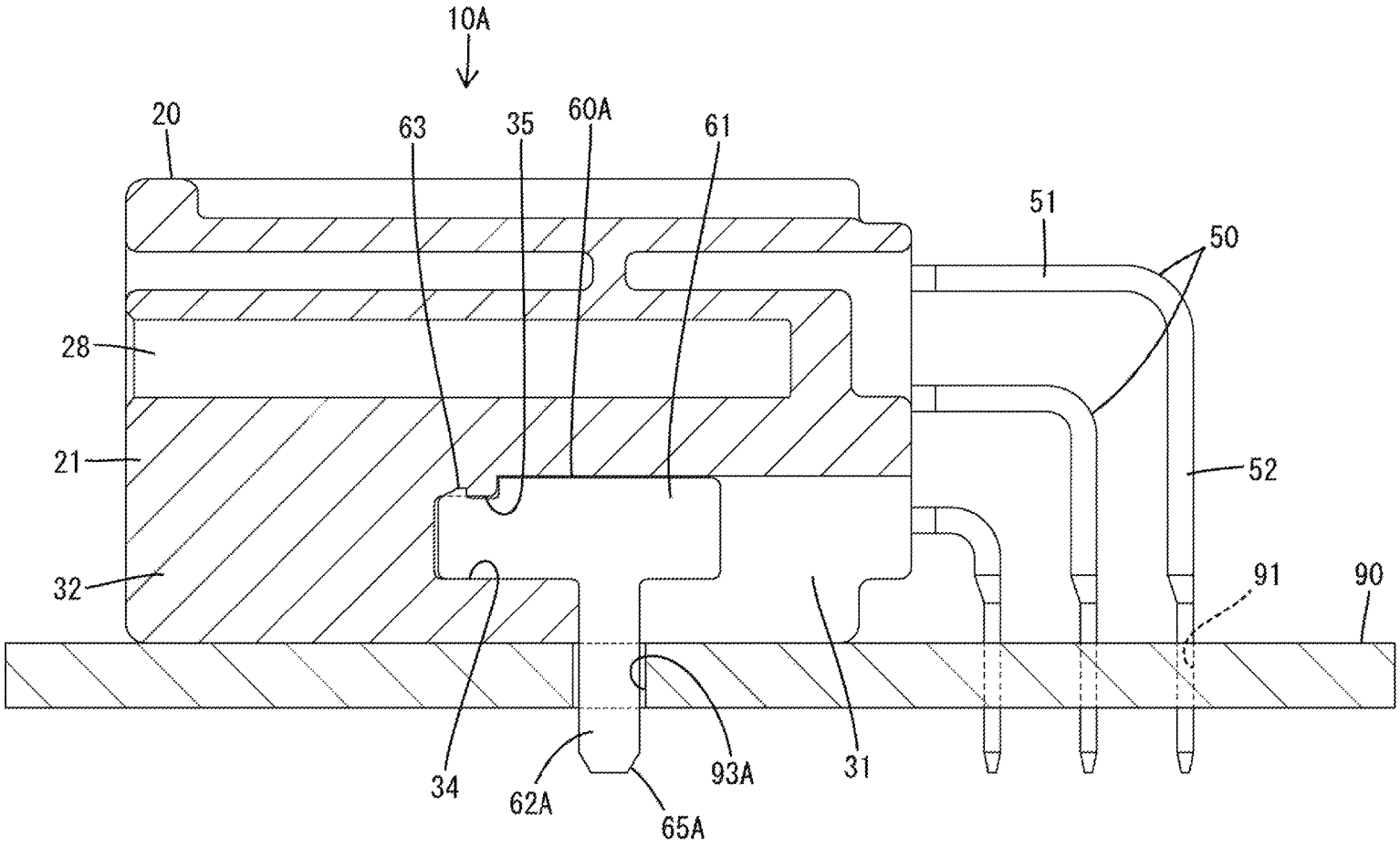
FIG. 7 is a view, corresponding to FIG. 3, of a second embodiment of the invention.
Figure 8:
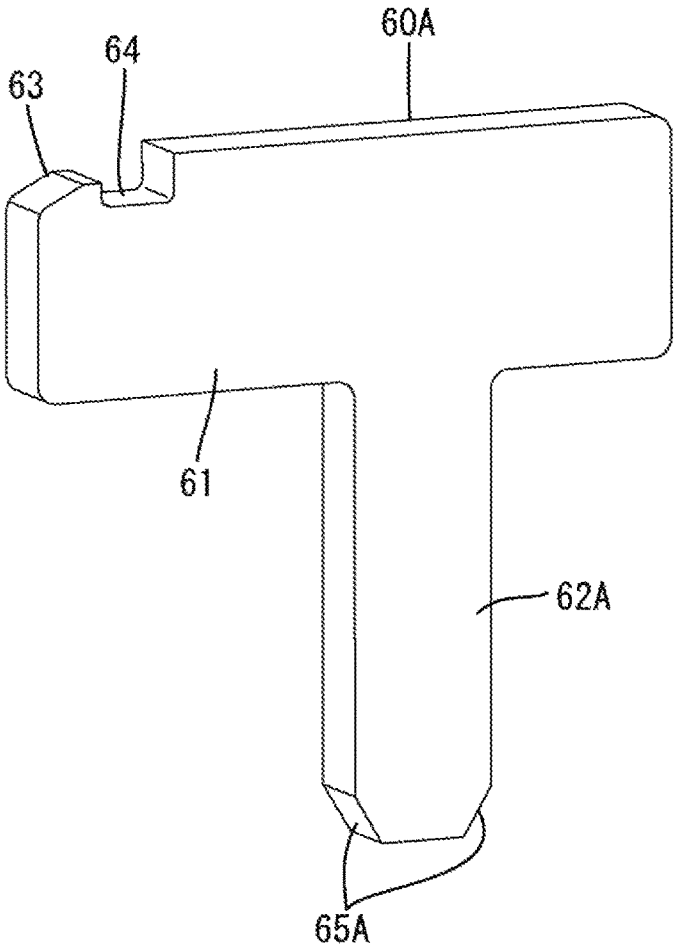
FIG. 8 is a view, corresponding to FIG. 6, of the second embodiment.

FIGS. 7 and 8 show a second embodiment of the invention. A board connector 10A of the second embodiment differs from the first embodiment in the form of fixing members 60A.

The fixing member 60A is a plate piece made of metal and is formed integrally to be T-shaped in a side view. Specifically, the fixing member 60A includes an inserting piece 61 extending in a front-rear direction and a fixing piece 62A extending down from an intermediate position of the inserting piece in the front-rear direction, specifically a position slightly behind a center in the front-rear direction, and is arranged with plate surfaces oriented in a width direction. The fixing piece 62A is a strip plate having a larger width in the front-rear direction as compared to the first embodiment, and a guiding portion 65A narrowed in width in the front-rear direction toward a lower end is provided on a lower end part.

The guiding portions 65A guide the fixing pieces 62A into fixing holes 93 of the circuit board 90 as the receptacle 20 is placed on a surface of a circuit board 90. Thereafter, the fixing pieces 62A are fixed to the circuit board 90 by flow soldering or reflow soldering. The fixing member 60A of the second embodiment has a simple T shape in a side view formed by the inserting piece 61 and one fixing piece 62A so that the structure is simplified.

Figure 9:
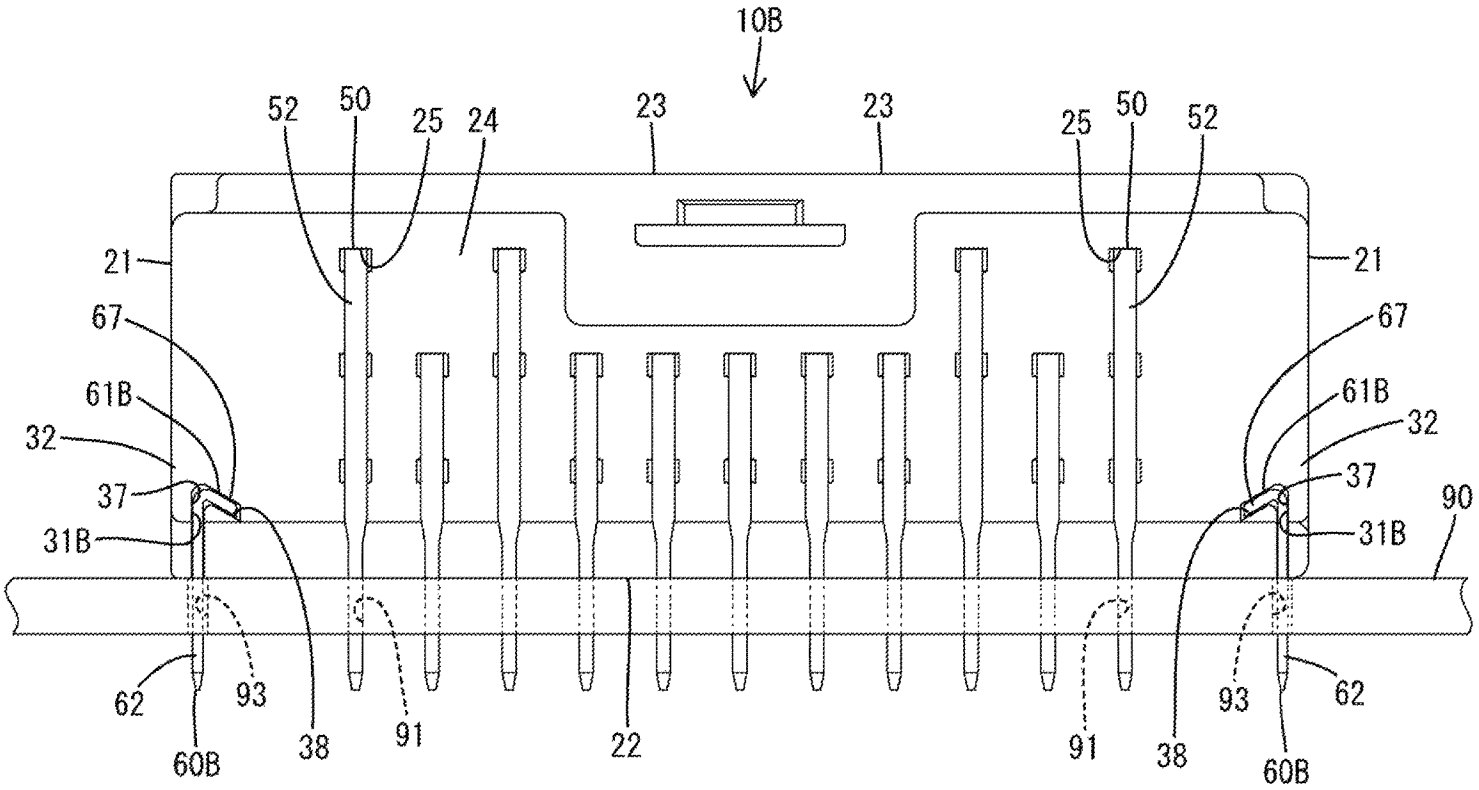
FIG. 9 is a view, corresponding to FIG. 4, of a third embodiment of the invention.
Figure 10:
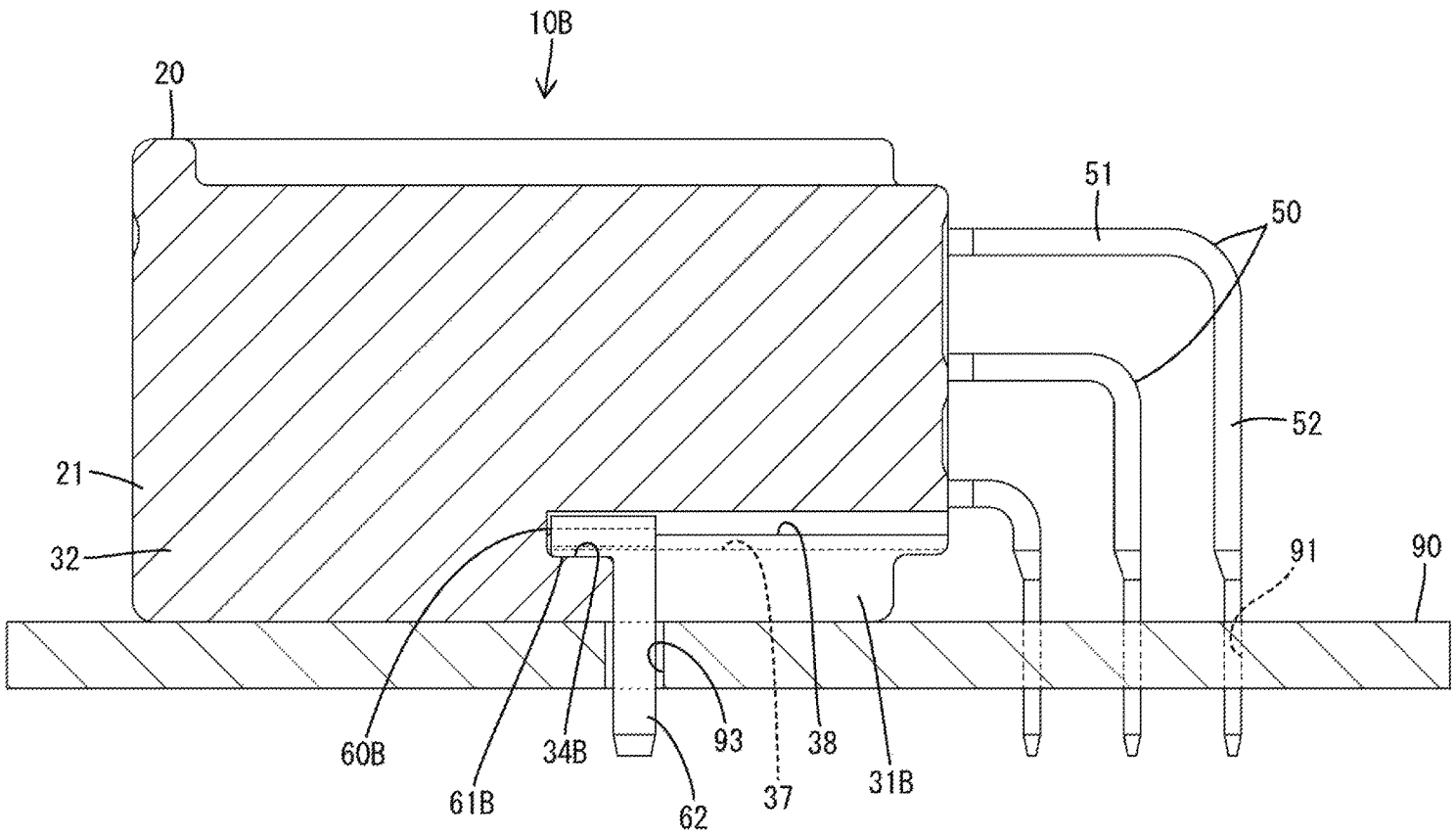
FIG. 10 is a view, corresponding to FIG. 3, of the third embodiment.
Figure 11:
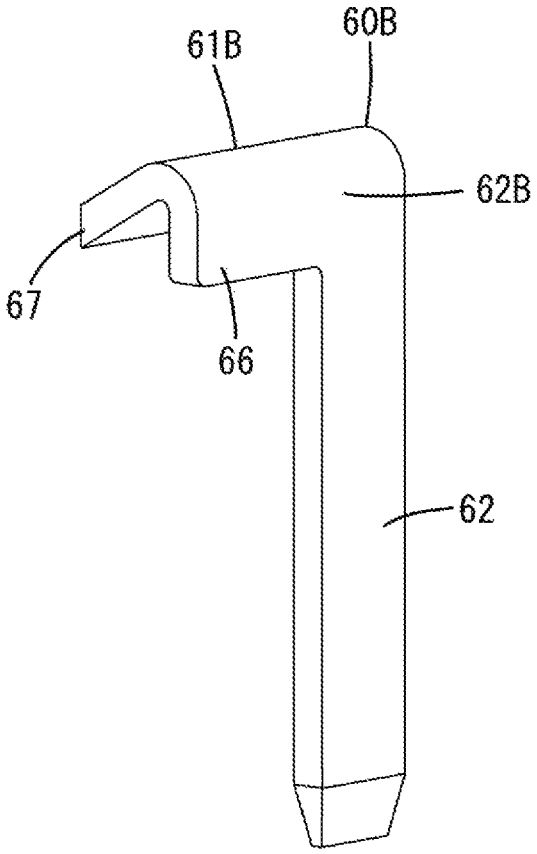
FIG. 11 is a view, corresponding to FIG. 6, of the third embodiment.

FIGS. 9 to 11 show a third embodiment of the invention. A board connector 10B of the third embodiment differs from the first embodiment in the forms of fixing members 60B and mounting recesses 31B.

The fixing member 60B is a plate piece made of metal and integrally formed to be L-shaped in a side view. Specifically, the fixing member 60B includes a long fixing piece 62 extending in a vertical direction and a short inserting piece 61B extending forward from the upper end of the fixing piece 62 and has plate surfaces oriented in a width direction. Further, the inserting piece 61B is composed of a first piece 66 extending in a height direction from the fixing piece 62 and a second piece 67 extending obliquely down at an acute angle from the upper end of the first piece 66 to define a V-shape in a front view.

As shown in FIG. 9, the mounting recesses 31B are within wall thicknesses of lower parts 32 of both side walls 21. Each mounting recess 31B is long in the front-rear direction and short in the height direction with slit-like openings on rear ends. As shown in FIG. 10, the front end of the mounting recess 31B is near a center of a receptacle 20 in the front-rear direction and the upper end is located below a center of the receptacle 20 in the height direction. A front end lower part of the mounting recess 31B is behind a front end upper part and a step 34B extends along the front-rear direction between the front end lower part and the front end upper part of the mounting recess 31B.

The upper part of the mounting recess 31B has a V-shape when viewed from behind. The V-shape is defined by a first insertion portion 37 that receives the first piece 66 and a second insertion portion 38 that intersects the upper end of the first insertion portion 37 at an acute angle to extend obliquely down and in. As shown in FIG. 10, the first and second insertion portions 37, 38 are provided over the entire length of the mounting recess 31B in the front-rear direction.

The fixing member 60B is inserted into the mounting recess 31B from behind so that the inserting piece 61B of the fixing member 60B is inserted along the step 34B and press-fit into a front part of the mounting recess 31B. The mounting of the inserting piece 61B is completed when the fixing piece 62 contacts and stops against the front end lower part of the mounting recess 31B with the lower part of the fixing piece 62 projecting down from the side wall 21. Further, the first piece 66 is aligned with and fit into the first insertion portion 37 and the second piece 67 is aligned with and fit into the second insertion portion 38. In this way, the fixing member 60B is restrained strongly from displacing down from the receptacle 20. Thereafter, the receptacle 20 is placed on a surface of a circuit board 90 so that the fixing pieces 62 are inserted into fixing holes 93 of the circuit board 90 and are fixed to the circuit board 90 by flow soldering or reflow soldering.

The fixing member 60B of the third embodiment has a simple L shape defined by the inserting piece 61B and one fixing piece 62. Further, the inserting piece 61B has a V-shaped cross-section so that fixing strength of the fixing member 60B to the circuit board 90 is enhanced.

Figure 12:
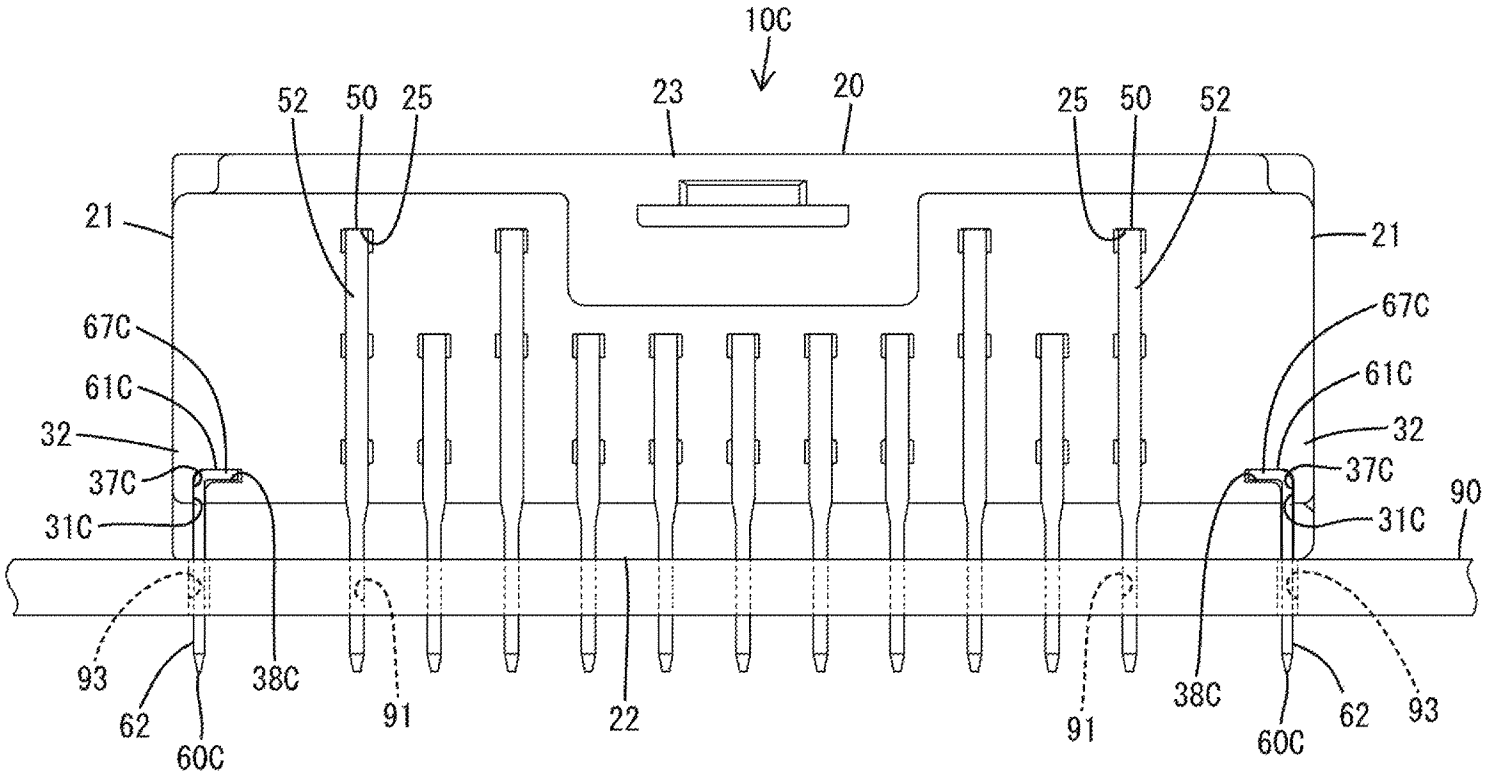
FIG. 12 is a view, corresponding to FIG. 4, of a fourth embodiment of the invention.
Figure 13:
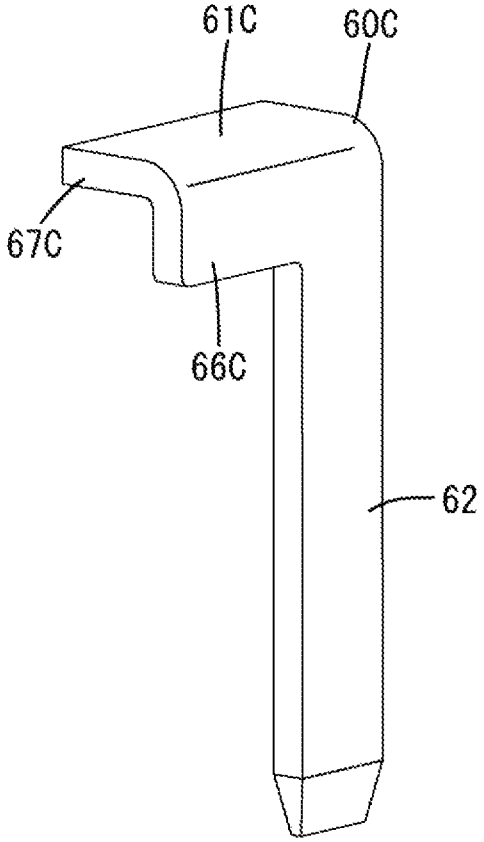
FIG. 13 is a view, corresponding to FIG. 6, of the fourth embodiment.

FIGS. 12 and 13 show a fourth embodiment of the invention. A board connector 10C of the fourth embodiment differs from the first embodiment in the forms of fixing members 60C and mounting recesses 31C.

The fixing member 60C is a unitary metal plate with a long fixing piece 62 extending vertically and a short inserting piece 61C extending forward from the upper end of the fixing piece 62 to define an L-shape in side view with plate surfaces oriented in a width direction. The inserting piece 61C is composed of a first piece 66C connected to the fixing piece 62 and arranged along a height direction and a second piece 67C extending orthogonally and horizontally from the upper end of the first piece 66C so that the inserting is L-shaped in a front view.

The mounting recesses 31C extends long in a front-rear direction and short in the height direction within wall thicknesses of lower parts 32 of both side walls 21. The mounting recesses 31C form slit-like openings on rear ends and on lower ends. An upper part of the mounting recess 31C has an L-shape when viewed from behind. The L-shape has a first insertion portion 37C to receive the first piece 66C and a second insertion portion 38C extends perpendicularly and horizontally from the upper end of the first insertion portion 37C. The insertion portions 37C, 38C extend over the entire length of the mounting recess 31C in the front-rear direction.

The fixing member 60C is inserted into the mounting recess 31C from behind until the inserting piece 61C reaches a front end of the mounting recess 31C. More particularly, the first piece 66C is aligned with and fit into the first insertion portion 37C and the second piece 67C is aligned with and fit into the second insertion portion 38C, thereby preventing downward displacement of the fixing member 60C from the receptacle 20. Thereafter, the receptacle 20 is placed on a surface of a circuit board 90 so that the fixing pieces 62 are inserted into fixing holes 93 of the circuit board 90 and are fixed to the circuit board 90 by flow soldering or reflow soldering.

The fixing member 60C of the third embodiment has a simple L shape in a side view formed by the inserting piece 61C and one fixing piece 62C.

Figure 14:
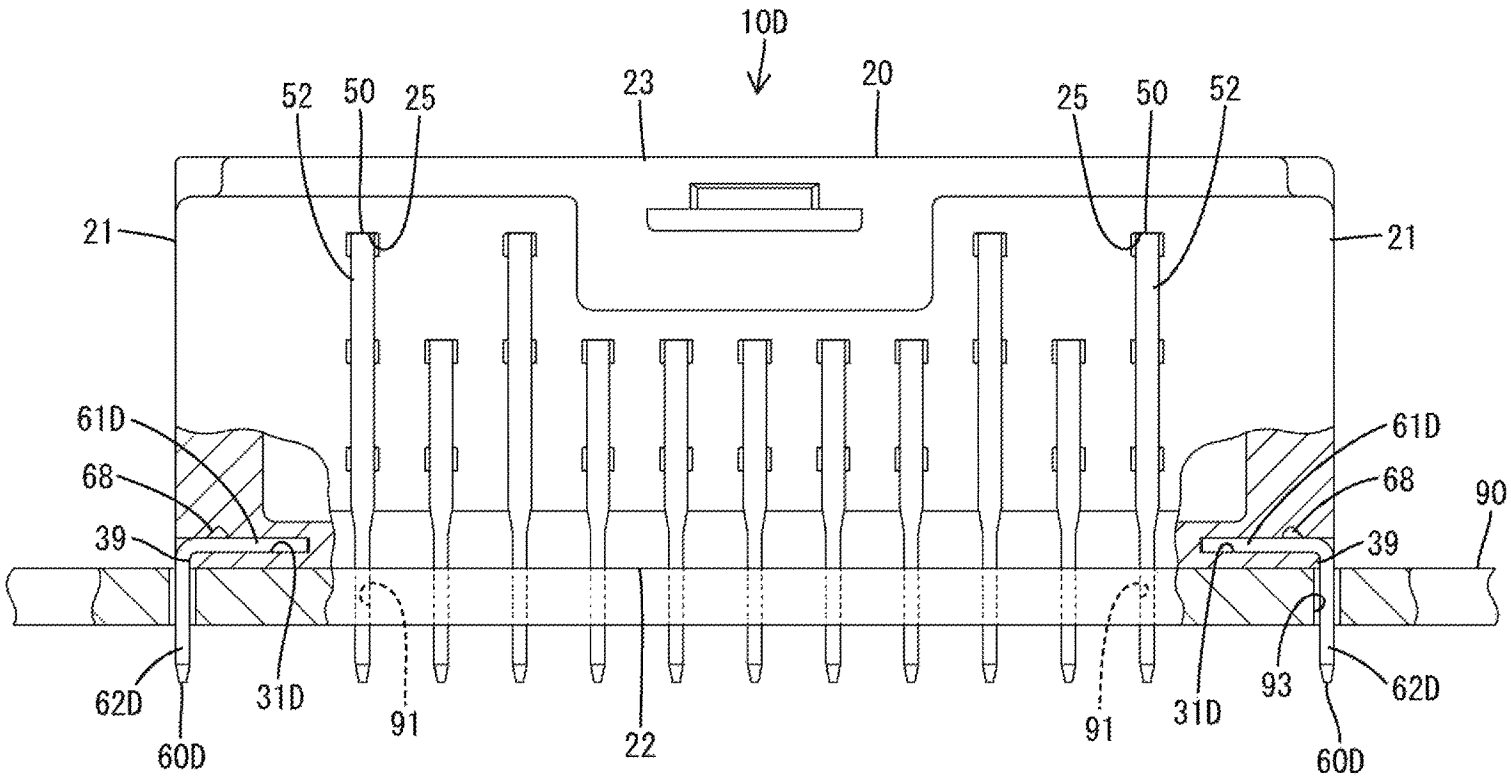
FIG. 14 is a back view partly in section of a board connector mounted on a circuit board in a fifth embodiment of the invention.
Figure 15:
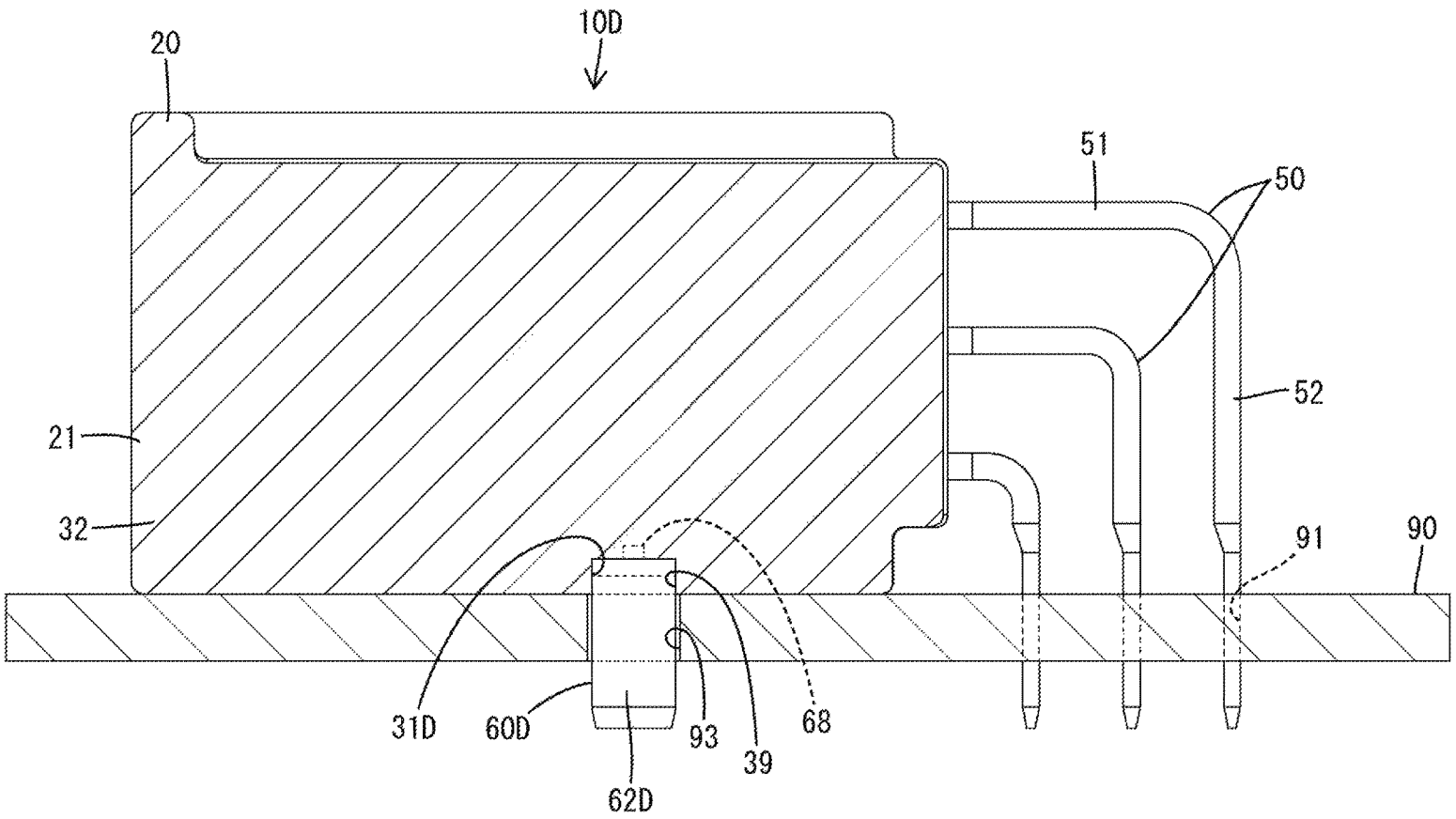
FIG. 15 is a view, corresponding to FIG. 3, of the fifth embodiment.
Figure 16:
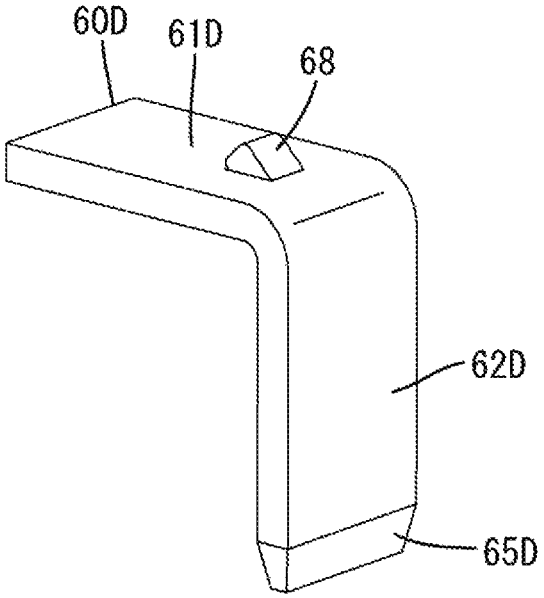
FIG. 16 is a view, corresponding to FIG. 6, of the fifth embodiment.

FIGS. 14 to 16 show a fifth embodiment of the invention. A board connector 10D of the fifth embodiment differs from the first embodiment in the forms of fixing members 60D and mounting recesses 31D and further in the arrangement of the mounting recesses 31D.

The fixing member 60D is a metal plate and integrally formed to be L-shaped in a front view. Specifically, the fixing member 60D includes an inserting piece 61D extending in a width direction and a fixing piece 62D extending down from one widthwise end of the inserting piece 61D, and is arranged with plate surfaces oriented in a front-rear direction. The inserting piece 61D and the fixing piece 62D are formed to have substantially equal lengths (lengths in extending directions). A locking projection 68 triangular in a front view is provided at a position near the fixing piece 62D in a central part of the upper surface of the inserting piece 61D in the front-rear direction. A lower end part of the fixing piece 62D is provided with a guiding portion 65D tapered to a lower end.

At a position slightly behind a center of a receptacle 20 in the front-rear direction (see FIG. 15), the mounting recesses 31D extend horizontally within wall thicknesses of both side walls 21 and a bottom wall 22 from lower end parts (parts overlapping with the bottom wall 22 in a height direction) of the side walls 22 to both widthwise end parts of the bottom wall 22 (see FIG. 14). Further, the mounting recess 31D has a slit-like cross-section to correspond to a cross-sectional shape of the inserting piece 61D in a side view and, unlike the first embodiment, is open from the side surface to the lower surface of a lower part of the side wall 21 without being open on the lower surface of the bottom wall 22. An opening end part of the mounting recess 31D is formed with an accommodation space portion 39 for accommodating the fixing piece 62D.

The inserting piece 61D of the fixing member 60D is inserted laterally into the mounting recess 31D so that the locking projection 68 bites into an inner upper surface of the mounting recess 31D to be locked, thereby restraining the fixing member 60D from coming out from the receptacle 20. Further, an upper end part of the fixing piece 62D is inserted into the accommodation space 39 of the mounting recess 31D and the side surface of the fixing piece 62D is continuous and flush with the side surface of the side wall 21. Therefore the fixing piece 62D does not project from the side surface of the side wall 21. Furthermore, parts of the fixing piece 62D other than the upper end project down from the side wall 21. The receptacle 20 then is placed on a surface of a board connector 90 so that the fixing pieces 62D are inserted into fixing holes 93 of the circuit board 90 and are fixed to the board connector 90 by flow soldering or reflow soldering.

The mounting recesses 31D of the fifth embodiment also are in the bottom wall 22 and formation areas of the mounting recesses 31D are ensured sufficiently. Thus, fixing strength of the fixing members 60D to the mounting recesses 31D can be enhanced.

Other embodiments are briefly described below.

The mounting recesses may be provided only within the wall thickness of the bottom wall.

The fixing member may be soldered along the surface of the circuit board without being inserted into the fixing holes of the circuit board.

The fixing member may include a resilient piece to be resiliently locked to the underside of the circuit board after being inserted into the fixing hole of the circuit board.

List of Reference Signs

| | |
|---|---|
| 10, 10A, 10B, 10C, 10D | board connector |
| 20 | receptacle |
| 21 | side wall |
| 22 | bottom wall |
| 23 | ceiling wall |
| 24 | back wall |
| 28 | erroneous connection prevention receiving groove |
| 31, 31B, 31C, 31D | mounting recess |
| 50 | terminal fitting |
| 60, 60A, 60B, 60C, 60D | fixing member |
| 61, 61A, 61B, 61C, 61D | inserting piece |
| 62, 62A, 62B, 62C, 62D | fixing piece |
| 90 | circuit board |

What is claimed is:

1. A board connector to be connected to a circuit board, the board connector comprising:

a forwardly-open receptacle fittable to a mating connector, the receptacle defining a substantially rectangular tube and having a bottom wall, two side walls projecting from opposite side edges of the bottom wall and facing each other in a width direction, a ceiling wall extending between the two side walls and facing the bottom wall in a height direction, each of the side walls including an erroneous connection prevention receiving groove open into the receptacle and spaced from the bottom wall;

mounting recesses formed within a wall thickness of each of the side walls at a position below the respective erroneous connection prevention receiving groove and at least partly aligned with the respective erroneous connection prevention receiving groove in the height direction, each of the mounting recesses having a rear-facing opening and a front wall opposite the rear-facing opening, and a bottom opening penetrating through the bottom wall, and a step extending in a front to rear direction forward of the bottom opening; and fixing members inserted respectively into the respective mounting recesses for fixing the receptacle to the circuit board, each of the fixing members having a planar forward-facing inserting piece dimensioned to be inserted along the step and to lockably engage a portion of the respective mounting recess, and at least one fixing piece projecting from the forward-facing inserting piece in the height direction and in a common plane with the forward-facing inserting piece, the at least one fixing piece extending through the bottom opening to engage the circuit board.

2. The board connector of claim 1, wherein the receptacle has a back wall and the mounting recess is open toward a side from which a terminal fitting to be mounted through the back wall is to be inserted.

3. The board connector of claim 1, wherein a part of the side wall between the erroneous connection prevention receiving groove and the bottom wall having a larger height than a part of the side wall between the erroneous connection prevention receiving groove and the ceiling wall.

4. The board connector of claim 1, wherein the fixing member is a metal plate.

5. The board connector of claim 1, further comprising a second step spaced from and facing the step in a height direction.

6. The board connector of claim 5, further comprising a locking projection on the insertion piece of the at least one forward-facing fixing member configured to lockably engage the second step.

* * * * *